US007621155B2

(12) United States Patent
Ahn

(10) Patent No.: US 7,621,155 B2
(45) Date of Patent: Nov. 24, 2009

(54) STEAM GENERATOR AND LAUNDRY MACHINE HAVING THE SAME

(75) Inventor: In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 216 days.

(21) Appl. No.: 11/649,887

(22) Filed: Jan. 5, 2007

(65) Prior Publication Data

US 2007/0186593 A1 Aug. 16, 2007

(30) Foreign Application Priority Data

Jan. 6, 2006 (KR) ..... 10-2006-0001877

(51) Int. Cl.
*D06F 39/04* (2006.01)

(52) U.S. Cl. ..... 68/15; 68/207

(58) Field of Classification Search ..... 68/15, 68/207; 73/304 R, 304 C; 134/184, 198
See application file for complete search history.

(56) References Cited

U.S. PATENT DOCUMENTS

| | | | | | |
|---|---|---|---|---|---|
| 1,961,893 | A * | 6/1934 | Wadman et al. | ..... | 414/161 |
| 2,411,309 | A * | 11/1946 | Whitcomb et al. | ..... | 414/613 |
| 2,653,304 | A * | 9/1953 | Wadsworth | ..... | 439/738 |
| 3,036,736 | A * | 5/1962 | Murphy et al. | ..... | 222/23 |
| 3,657,556 | A * | 4/1972 | Foster | ..... | 307/118 |
| 3,755,804 | A * | 8/1973 | Johnson | ..... | 340/607 |
| 4,092,519 | A * | 5/1978 | Eaton-Williams | ..... | 392/325 |
| 4,480,901 | A * | 11/1984 | Osegowitsch et al. | ..... | 396/617 |
| 4,948,947 | A * | 8/1990 | Kang | ..... | 392/386 |
| 5,315,773 | A * | 5/1994 | Iwami et al. | ..... | 38/77.6 |
| 5,347,665 | A * | 9/1994 | Kumon et al. | ..... | 4/541.1 |
| 5,969,620 | A * | 10/1999 | Okulov | ..... | 340/620 |
| 6,246,831 | B1 * | 6/2001 | Seitz et al. | ..... | 392/486 |
| 6,513,377 | B1 * | 2/2003 | Sassi et al. | ..... | 73/304 R |
| 6,568,264 | B2 * | 5/2003 | Heger | ..... | 73/304 C |
| 6,577,815 | B1 * | 6/2003 | Wu | ..... | 392/402 |
| 6,622,557 | B2 * | 9/2003 | Petzold | ..... | 73/304 C |
| 2005/0144735 | A1 * | 7/2005 | Yang et al. | ..... | 8/149.3 |
| 2006/0277690 | A1 * | 12/2006 | Pyo et al. | ..... | 8/149.2 |
| 2007/0175833 | A1 * | 8/2007 | Ikeboh et al. | ..... | 210/748 |

FOREIGN PATENT DOCUMENTS

| | | | |
|---|---|---|---|
| DE | 31 36 864 | * | 4/1983 |
| DE | 32 26 928 | * | 1/1984 |
| DE | 36 27 988 | * | 4/1987 |
| EP | 1 507 029 A2 | | 2/2005 |
| JP | 5-196204 | * | 8/1993 |
| JP | 6-106008 | * | 4/1994 |
| JP | 3-75100 | * | 3/1999 |

(Continued)

*Primary Examiner*—Frankie L Stinson
(74) *Attorney, Agent, or Firm*—McKenna Long & Aldridge LLP

(57) ABSTRACT

Disclosed herein are a steam generator and a laundry machine having the same which can prevent malfunction of a water level sensor. The steam generator includes a common electrode part, a low water-level electrode part which senses a low water level, and a high water-level electrode part which senses a high water level, the high water-level electrode part having a lower end which is positioned above a lower end of the low water-level electrode part and an upper end which is positioned above the low water-level electrode part.

13 Claims, 9 Drawing Sheets

FOREIGN PATENT DOCUMENTS

| | | | |
|---|---|---|---|
| JP | 2000266302 | * | 9/2000 |
| JP | 2003-56871 | * | 2/2003 |
| JP | 2003-307341 | * | 10/2003 |
| KR | 10-2005-0091294 | A | 9/2005 |
| KR | 10-2005-0108788 | A | 11/2005 |

* cited by examiner

STEAM GENERATOR AND LAUNDRY MACHINE HAVING THE SAME

This application claims the benefit of Korean Patent Application No. 10-2006-0001877, filed on Jan. 6, 2006, which is hereby incorporated by reference as if fully set forth herein.

BACKGROUND OF THE INVENTION

1. Field of the Invention

The present invention relates to a steam generator and a laundry machine having the same, and more particularly to a steam generator and a laundry machine having the same which can prevent malfunction of a water level sensor which measures a water level.

2. Discussion of the Related Art

Generally, a laundry machine includes a washer for washing clothes and a dryer for drying wet clothes.

A washer is classified into a pulsator type washer which washes laundry by water current generated by rotating a pulsator, and a drum type washer which washes laundry by drop and frictional force of washing water and laundry generated by rotating a horizontally mounted drum.

A dryer dries wet clothes by supplying hot air to wet clothes.

Recently, a drum type washer which washes laundry by using steam has been proposed. If using steam for washing laundry, water and electricity can be saved, and washing performance can be improved. Also, creases and odor can be removed.

A conventional drum type washer using steam will now be described with reference to FIG. 1.

The conventional drum type washer includes a cabinet 10 which forms an external appearance, a cylindrical tub 20 which is horizontally mounted in the cabinet 10 and contains washing water, a drum 30 which is rotatably mounted in the tub 20, and a driving motor (not shown) which drives the drum 30. The cabinet 10 is provided with an opening 13 at a front panel, which is communicated with the inside of the drum 30 for putting laundry into the drum 30 and taking laundry out of the drum 30, and a door 11 for opening and closing the opening 13. The drum type washer further includes a water-supply valve 15 which is connected to an external water pipe (not shown) to supply washing water into the tub 20. A hot-water pipe 25*a* and a cold-water pipe 26 extend from the water-supply valve 15 to a detergent box 27.

The drum type washer further includes a steam generator 50 for supplying steam into the drum 30. A water-supply hose 25 and a steam-supply pipe 53 for guiding the generated steam into the drum 30 are connected to the steam generator 50. The water-supply hose 25 is typically connected to a hot-water side of the water-supply valve 15. The steam-supply pipe 53 has a nozzle-shaped front end so as to effectively inject steam into the drum 30, which is exposedly mounted to the inside of the drum 30.

Referring to FIGS. 2 and 3, a structure of the steam generator 50 will now be described in detail.

The steam generator 50 includes a housing 80 which has a lower housing 81 which forms an outer appearance and provides a space for storing water and an upper housing 82 which is coupled to an upper portion of the lower housing 81, and a heater 55 which heats the water stored in the housing 80.

The upper housing 82 is formed with a water-supply port 52*a* to which the water-supply hose 25 is connected to guide the water into the housing 80, and a discharge port 52*b* to which the steam-supply pipe 53 is connected to supply the generated steam into the drum 20.

The heater 55 is mounted to a lower portion in the lower housing 81 so as to be immersed in the water flowing into the housing 80 of the steam generator 50. In order to operate the heater 55 while the heater 55 is immersed in the water, a water level sensor 60 is mounted to the upper housing 82 of the steam generator 50. The water level sensor 60 measures the water level in the housing 80, so that the water level in the housing 80 can be always kept to an adequate level. In other words, when the water level in the housing 80 of the steam generator 50 is less than a preset reference level, the water-supply valve 15 is opened to supplement water. When the water level in the housing 80 is the reference level or more, the water-supply valve 15 is closed to stop the water supply, and the heater 55 is operated to generate steam.

Also, a temperature sensor 57 is mounted to the upper housing 82 of the steam generator 50 to measure temperature of the water heated by the heater 55 and the steam. When the temperature measured by the temperature sensor 57 is a preset reference value or more, the power applied to the heater 55 is interrupted to prevent overheating of the heater 55.

Describing the water level sensor 60 in detail, the water level sensor 60 includes a receptacle housing 61 which forms an outer appearance and is configured to be fixed to the upper housing 82 of the steam generator 50, and electrode parts 62, 63 and 64 which are mounted downward at the receptacle housing 61 and sense the water level in the housing 80 of the steam generator 50.

The electrode parts 62, 63 and 64 extend downward from the receptacle housing 61 to respectively adequate heights from a bottom of the lower housing 81.

However, the above steam generator of the conventional washer has a problem of high possibility of malfunction of the water level sensor. The reason is as follows.

The water level sensor measures the water level in such a manner that when the electrode parts are immersed in the water, electric current flows. However, when the water is boiled by the operation of the heater, bubbles are generated and intensely spattered on inner walls of the steam generator. And, the bubbles rebound from the inner walls of the steam generator and are scattered in all directions, so that the bubbles get in touch with the electrode parts of the water level sensor and form water films thereon, thereby causing the malfunction of the water level sensor.

Also, when the water is supplied into the steam generator, a portion of water is spattered on the electrode parts, which also causes the malfunction of the water level sensor. Also, during the operation of the washer, vibration is generated and transmitted to the steam generator, so that the steam generator also vibrates to cause the water in the housing of the steam generator to slop from side to side to get in touch with the electrode parts of the water level sensor, thereby causing the malfunction of the water level sensor.

SUMMARY OF THE INVENTION

Accordingly, the present invention is directed to a steam generator and a laundry machine having the same that substantially obviate one or more problems due to limitations and disadvantages of the related art.

An object of the present invention is to provide a steam generator and a laundry machine having the same which can effectively prevent malfunction of a water level sensor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a steam generator comprises: a common electrode part; a low water-level electrode part which senses a low water level; and a high water-level electrode part which senses a high water level, the high water-level electrode part having a lower end which is positioned above a lower end of the low water-level electrode part and an upper end which is positioned above the low water-level electrode part. Preferably, the low water-level electrode part and the high water-level electrode part are spaced apart from each other by a predetermined distance.

Preferably, the high water-level electrode part is protrudingly mounted upward of the steam generator. Preferably, the steam generator further comprises an upper housing having an upwardly protruding portion, and the high water-level electrode part is mounted to the protruding portion.

In another aspect of the present invention, the steam generator further comprises an accommodating part for surrounding the high water-level electrode part. Preferably, the accommodating part has a lower end which is positioned above the lower end of the high water-level electrode part. The accommodating part may be formed with at least one cutting portion.

In a further aspect of the present invention, the high water-level electrode part includes an electrode which comes into contact with water, and a terminal part which is coupled to the electrode. Preferably, the electrode and the terminal part are coupled to each other by cocking. Preferably, the electrode and the terminal part are made of the same material.

In yet another aspect of the present invention, there is provided a steam generator comprising: a common electrode part; a low water-level electrode part which senses a low water level; and a high water-level electrode part which senses a high water level and is positioned apart from the low water-level electrode part by a predetermined distance. Preferably, the high water-level electrode part is separately provided from the low water-level electrode part. More preferably, the high water-level electrode part is separated from the low water-level electrode part by an accommodating part surrounding the high water-level electrode part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention associated with a steam generator and a laundry machine having the same, examples of which are illustrated in the accompanying drawings. Wherever possible, the same reference numbers will be used throughout the drawings to refer to the same or like parts.

Figure 1:
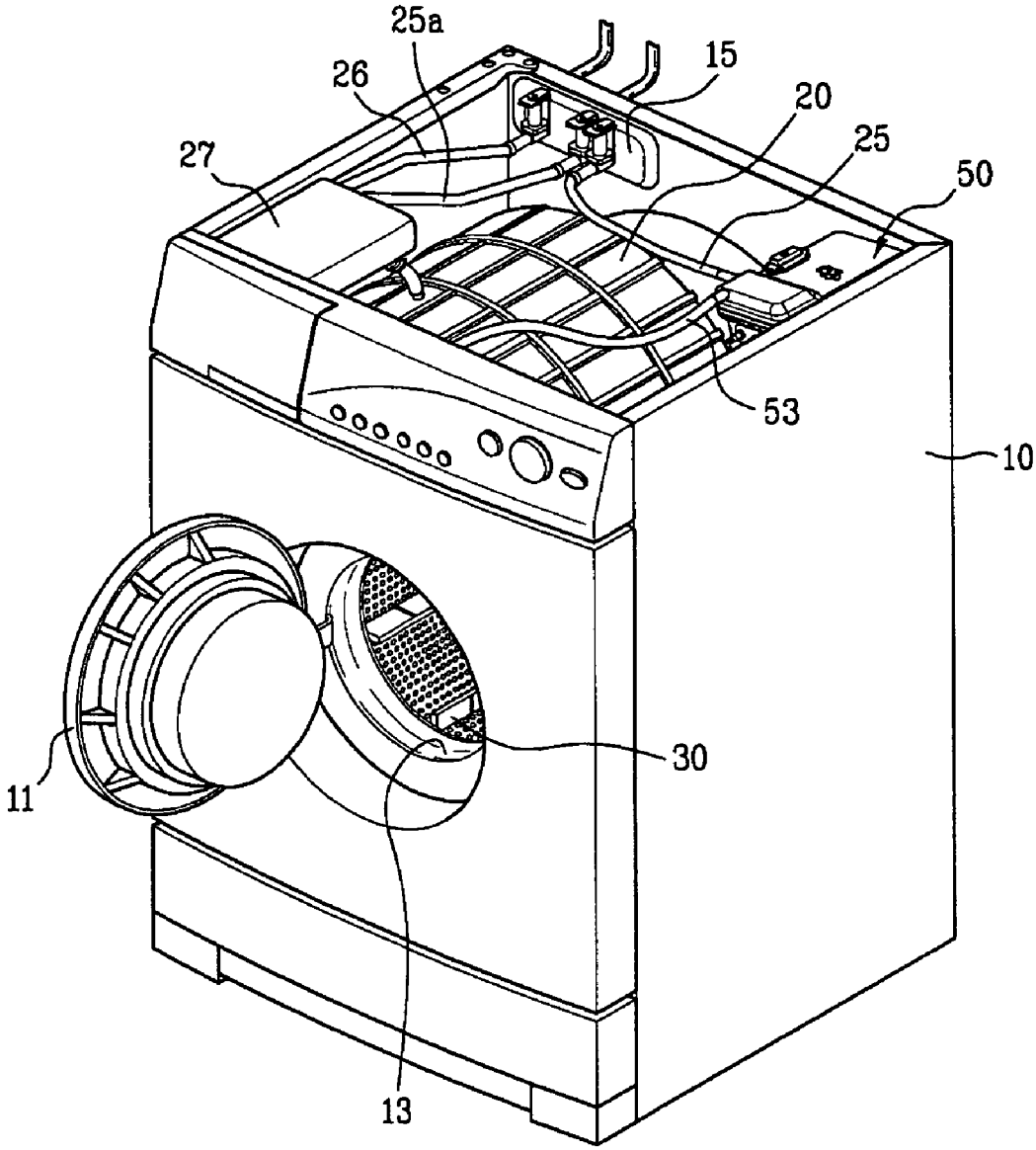
Fig. 1 Prior Art
FIG. 1 is a perspective view illustrating a structure of a conventional drum type washer.
Figure 2:
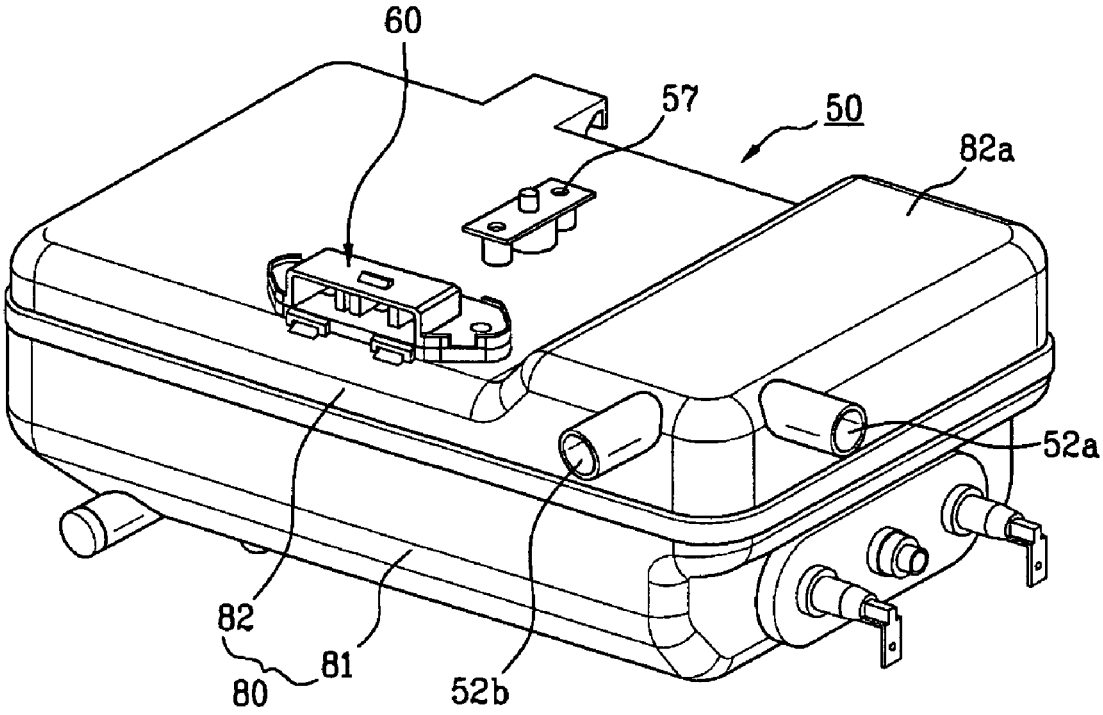
Fig. 2 Prior Art
FIG. 2 is a perspective view illustrating a steam generator of a conventional drum type washer.
Figure 3:
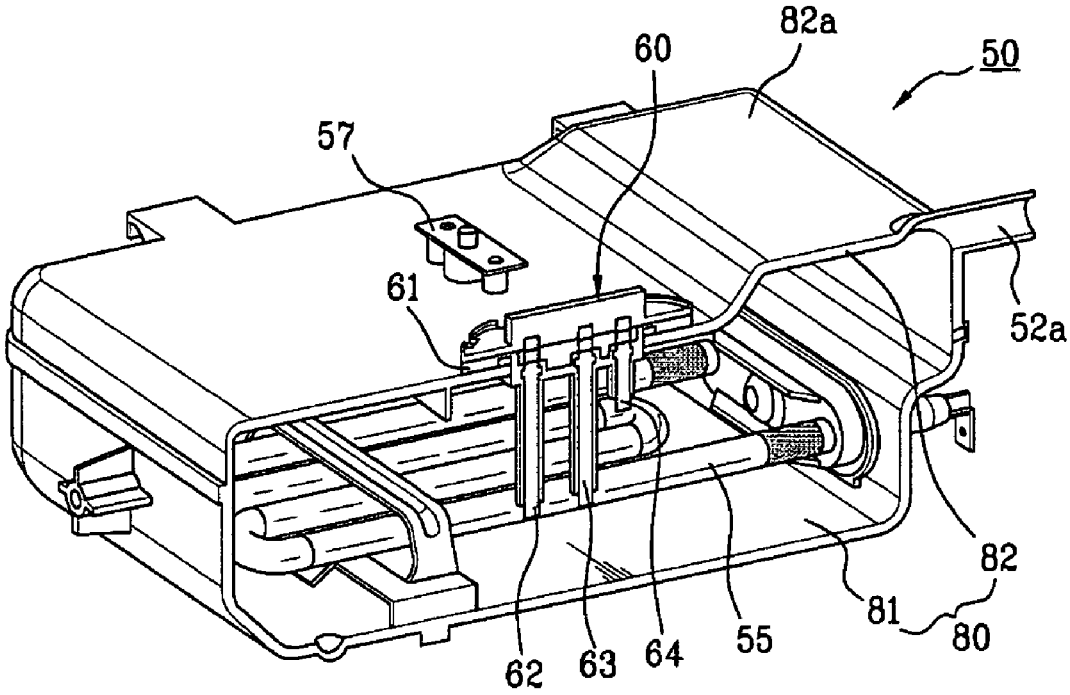
Fig. 3 Prior Art
FIG. 3 is a partial cut-away perspective view of a steam generator depicted in FIG. 2.
Figure 4:
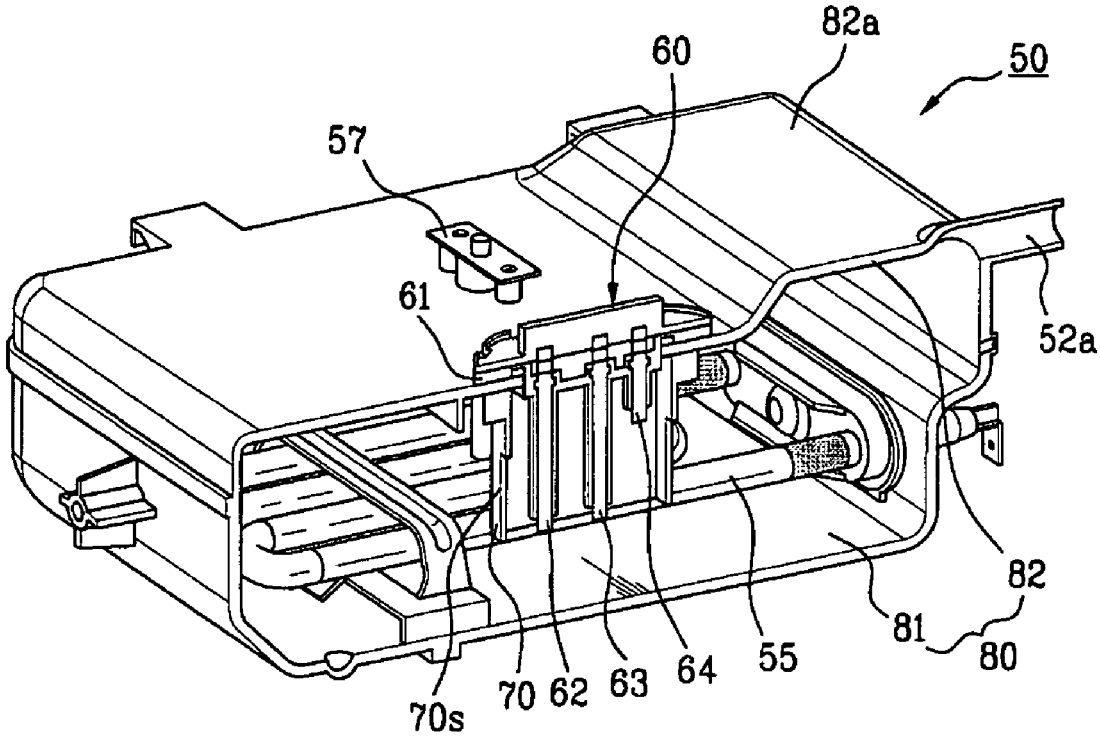
FIG. 4 is a perspective view illustrating a steam generator in accordance with an exemplary embodiment of the present invention.
Figure 5:
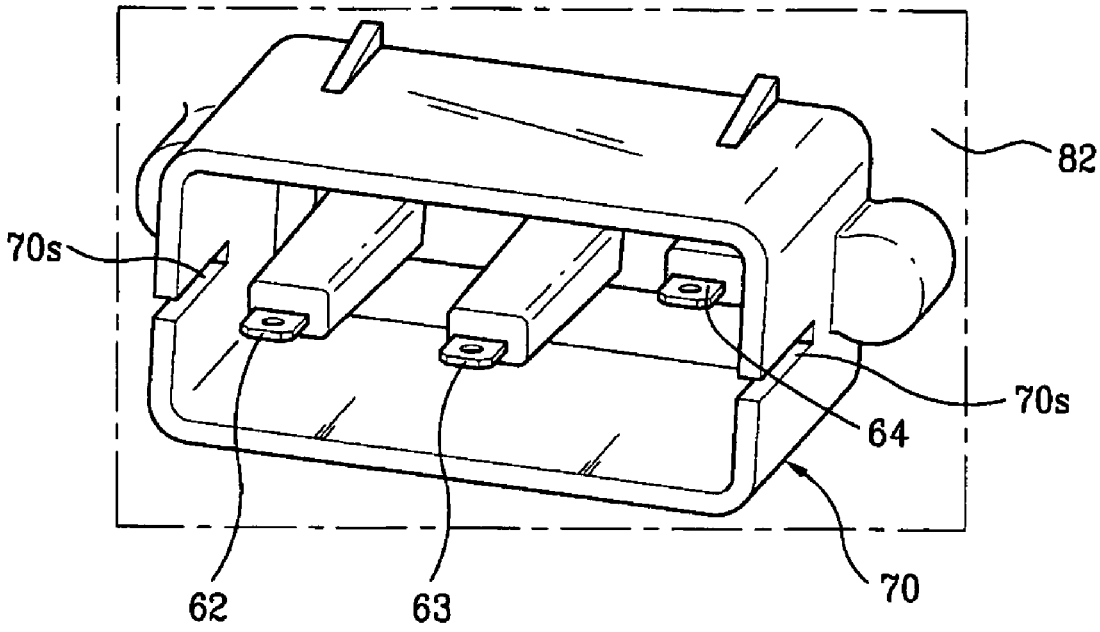
FIG. 5 is a perspective view illustrating a water level sensor of a steam generator depicted in FIG. 4.
Figure 6:
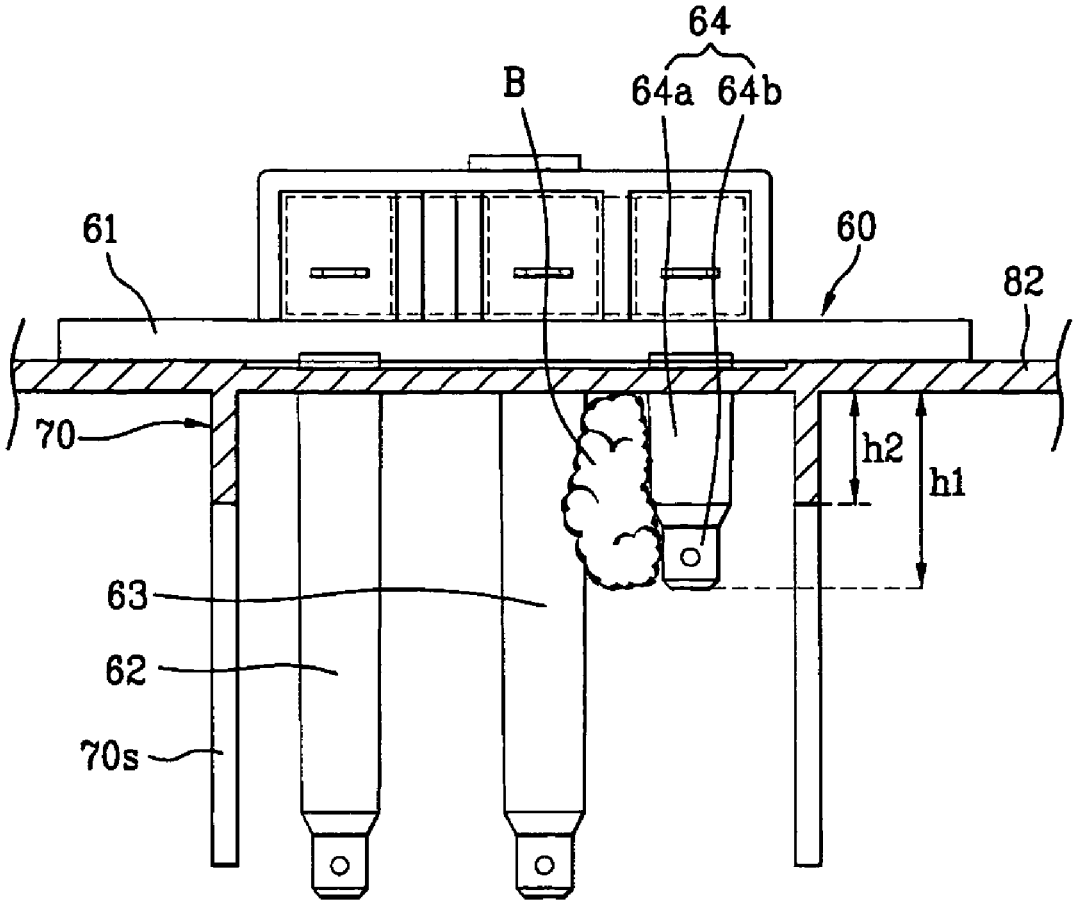
FIG. 6 is a sectional view illustrating a water level sensor of a steam generator depicted in FIG. 4.

A steam generator according to an exemplary embodiment of the present invention will now be described with reference to FIGS. 4 to 6.

A steam generator 50 of the present invention comprises a housing 80, a temperature sensor 57 and a water level sensor 60. The water level sensor 60 includes a receptacle housing 61 which is mounted to an outer surface of the housing 80, and a plurality of electrode parts 62, 63 and 64 which are mounted downward at the receptacle housing 61. The steam generator 50 further includes an accommodating part 70 for accommodating the electrode parts 62, 63 and 64 of the water level sensor 60.

The number of the electrode parts 62, 63 and 64 is not limited to three, and may be varied according to the water level to be measured. In order to sense the water level in the housing 80 of the steam generator 50, the electrode parts 62, 63 and 64 extend downward from the receptacle housing 61 to respectively adequate heights from a bottom of a lower housing 81. As shown in FIGS. 4 and 5, the electrode part 62 is a common electrode part which functions as a reference electrode for measuring the water level, the electrode part 63 is a low water-level electrode part for measuring the low water level, and the electrode part 64 is a high water-level electrode part for measuring the high water level. It is preferable that a length of the common electrode part 62 is equal to or more than a length of the low water-level electrode part 63. As shown in FIG. 6, each of the electrode parts includes an electrode 64*a* and an electrode film 64*b* coated on the electrode 64*a*.

An operational principle of the water level sensor 60 will now be described briefly.

When the common electrode part 62 and the low water-level electrode part 63 are immersed in the water stored in the housing 80 of the steam generator 50, electric current flows through the water to generate a low water-level sensing signal. And, when the water level in the housing 80 of the steam generator 50 further rises so that the high water-level electrode part 64 is immersed in the water, electric current flows to generate a high water-level sensing signal.

On the other hand, when the water is boiled by the operation of a heater 55, bubbles are intensely generated and may be spattered on the electrode parts 62, 63 and 64 to cause the malfunction of the water level sensor 60. Also, the water supplied through a water-supply port 52*a* may be spattered on the electrode parts 62, 63 and 64 to cause the malfunction of the water level sensor 60. Further, vibration generated during the operation of a laundry machine cannot be perfectly prevented from being transmitted to the steam generator 50. So, the water in the steam generator 50 is subject to slop from side to side to cause the malfunction of the water level sensor 60. In order to prevent such a problem of the malfunction of the water level sensor 60, the accommodating part 70 according to the present invention is provided.

Now, the accommodating part 70 will be described in detail.

Basically, the accommodating part 70 has a structure of surrounding the electrode parts 62, 63 and 64 and having an opened bottom. The accommodating part 70 is formed with cutting portions 70*s*. If a lower end of the accommodating part 70 is located above lower ends of the electrode parts 62, 63 and 64, the cutting portions 70*s* may not be formed. As long as the above conditions are satisfied, the accommodating part 70 may be formed in any shape. However, as shown in FIGS. 4 and 5, it is preferable that the accommodating part 70 is formed to have a cross section of a rectangular shape and the cutting portion 70*s* is formed in a slit shape. It is further preferable that an upper end of the cutting portion 70*s* is located above the lower end of the high water-level electrode part 64.

The lower housing 81 may be provided with a lower accommodating part (not shown) at a position corresponding to the accommodating part 70 of the upper housing 82, so as to be coupled to the lower portion of the accommodating part 70 or fitted into the accommodating part 70. Although the lower accommodating part is coupled to the accommodating part 70 of the upper housing 82 to cover the bottom of the accommodating part 70, the water can flow into the accommodating part 70 through the cutting portions 70*s* and can get in touch with the electrode parts 62, 63 and 64 of the water level sensor 60.

Hereinafter, an operation of the steam generator of a drum type washer of the present invention structured as above will be described.

Water is supplied into the steam generator 50 through the water-supply port 52*a*.

When the common electrode part 62 and the low water-level electrode part 63 are immersed in the water stored in the housing 80 of the steam generator 50, electric current flows through the water and the water level sensor 60 generates the low water-level sensing signal. And, when the water level in the housing 80 of the steam generator 50 further rises so that the high water-level electrode part 64 is immersed in the water, electric current flows through the water and the water level sensor 60 generates the high water-level sensing signal. In other words, the water level sensor 60 can measure the water level by the electric current flowing when the electrode parts 62, 63 and 64 are immersed in the water.

As described above, the accommodating part 70 can prevent the malfunction of the water level sensor 60. However, as shown in FIG. 6, the water level sensor 60 has a structure such that the high water-level electrode part 64 has a short length (h1) and is disposed adjacently to the low water-level electrode part 63, and the accommodating part 70 has a shorter length (h2, h2<h1) at a portion above the cutting portion 70*s*. Thus, bubbles B may be generated between the low water-level electrode part 63 and the high water-level electrode part 64 to form water films on the low and high water-level electrode parts 63 and 64, thereby causing the malfunction of the water level sensor 60. The below-described steam generator can more securely prevent the malfunction of the water level sensor 60.

Figure 7:
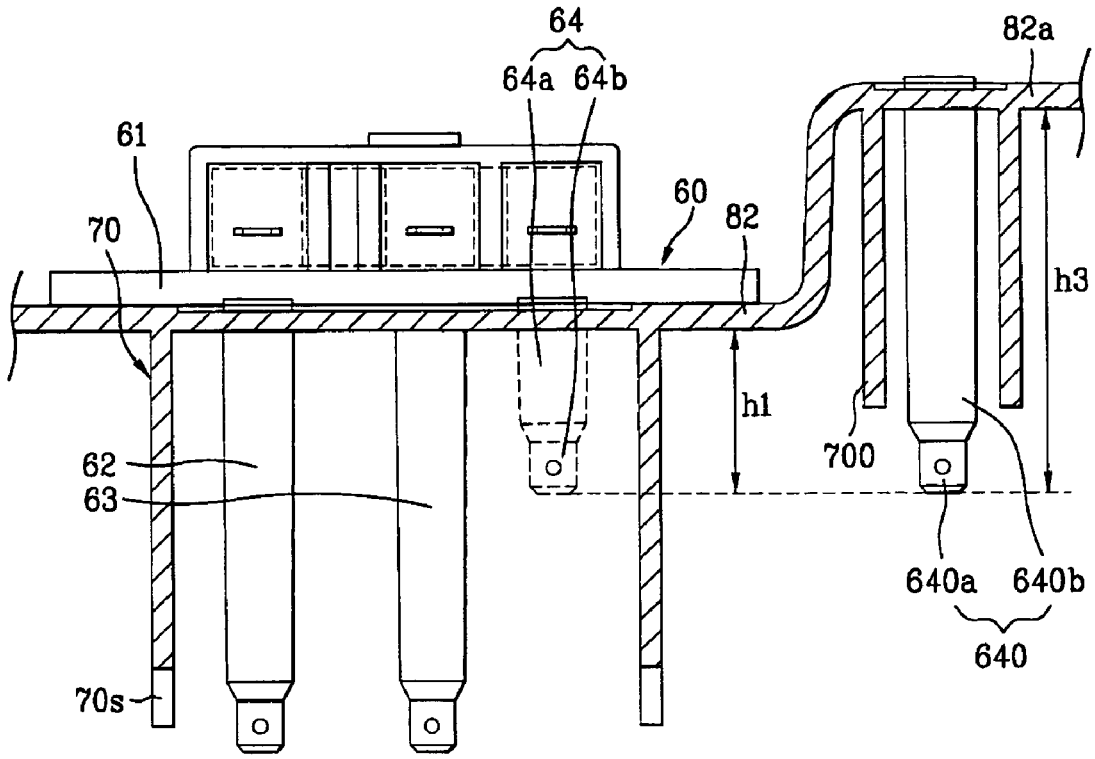
FIG. 7 is a sectional view illustrating a water level sensor of a steam generator in accordance with another exemplary embodiment of the present invention.

Referring to FIG. 7, the steam generator according to another exemplary embodiment of the present invention will be described.

The basic principle of the steam generator of this embodiment is the same as that of the steam generator of the previous embodiment. However, in the steam generator of this embodiment, the structure and mounting position of the high water-level electrode part are modified.

Describing in detail, a length of the high water-level electrode part 640 of this embodiment is relatively long (a length of h3), as compared with the previous embodiment (h3>h1). However, in order to sense the originally intended high water level, the lower end of the high water-level electrode part 640 should be positioned at the same height as the lower end of the high water-level electrode part 64 of the previous embodiment (shown by a hidden line in FIG. 7). To this end, a portion of the upper housing 82 where the high water-level electrode part 640 is mounted protrudes upward, however, this is not restricted thereto. Because the upper housing 82 of the steam generator is typically provided with a protruding portion 82*a*, it is preferable to mount the high water-level electrode part 640 to the existing protruding portion 82*a* without forming an additional protruding portion at the upper housing 82 to mount the high water-level electrode part 640.

More preferably, the high water-lever electrode part 640 is placed avoiding a place directly above the heater 55, especially the heat-generated part of the heater 55. Bubbles are made a lot directly above the heat-generated part of the heater 55. Further, the high water-lever electrode part 640 can be made the same as the low water-lever electrode part 63 or the common electrode 62 such that all the electrode parts can be the same at least in length to be exchangeable one another.

Similarly to the previous embodiment, the high water-level electrode part 640 may be disposed adjacently to the low water-level electrode part 63. However, as shown in FIG. 7, it is preferable that the high water-level electrode part 640 is spaced apart from the low water-level electrode part 63 by a predetermined distance. Also, it is preferable to form a second accommodating part 700 at the upper housing 82 to surround the high water-level electrode part 640. At this time, it is preferable that the lower end of the second accommodating part 700 is positioned above the lower end of the high water-level electrode part 640. Of course, the lower end of the second accommodating part 700 is disposed adjacently to the lower end of the high water-level electrode part 640, and the second accommodating part 700 may be formed with cutting portions (not shown). A non-described reference numeral 640*a* refers to an electrode, and a reference numeral 640*b* refers to an electrode film 640*b*.

Figure 8:
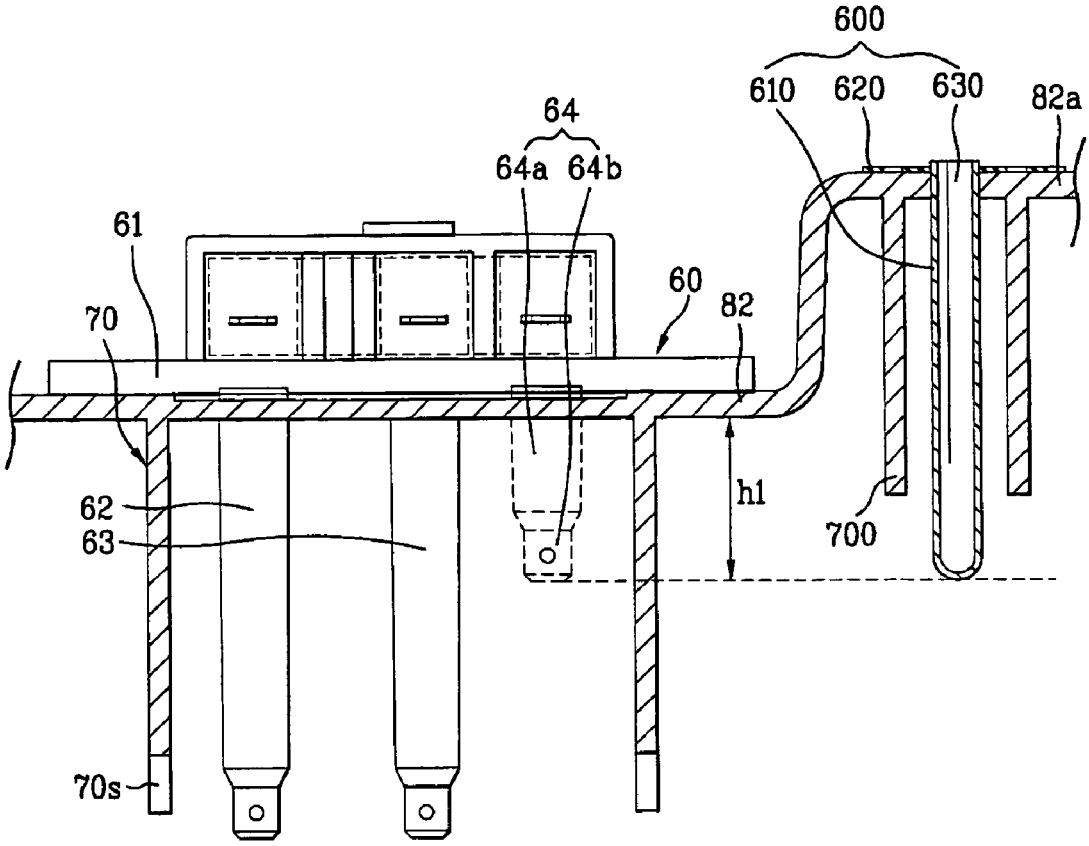
FIG. 8 is a sectional view illustrating a water level sensor of a steam generator in accordance with yet another exemplary embodiment of the present invention.
Figure 9:
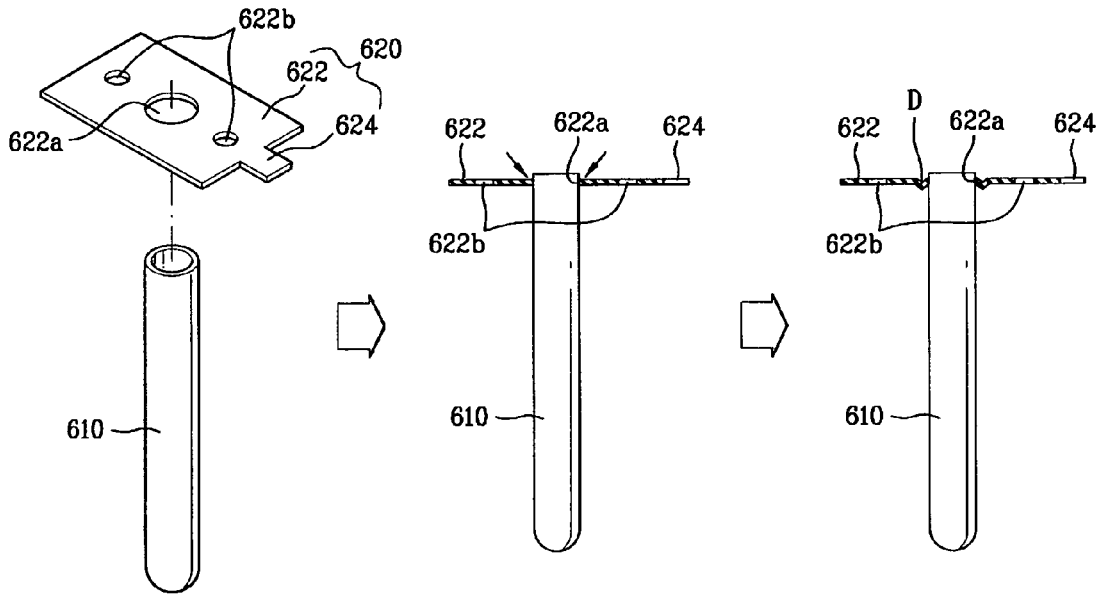
FIG. 9 is a view illustrating a manufacturing process of a high water-level electrode part of a water level sensor depicted in FIG. 8.

Referring to FIGS. 8 and 9, the steam generator according to yet another exemplary embodiment of the present invention will be described.

As described in the previous embodiment, by relatively elongating the length of the high water-level electrode part 640, the existing high water-level electrode part having the electrode and the electrode film can be used as it is (refer to FIG. 7). However, this embodiment is devised to modify the existing high water-level electrode part.

A high water-level electrode part 600 of this embodiment includes an electrode 610 which comes into contact with the water, and a terminal part 620 which is coupled to the electrode 610. It is preferable to form the electrode 610 in a hollow cylindrical shape, and to form the terminal part 620 in a plate shape. The terminal part 620 is formed with a coupling portion 622, to which the electrode 610 is coupled, and a contact portion 624 in an integral manner. The coupling portion 622 is provided with screw holes 622*b* for screw-coupling the terminal part 620 to the upper housing 82. Preferably, the electrode 610 and the terminal part 620 are made of the same material, for example, stainless steel 304 (STS 304).

Referring to FIG. 9, a manufacturing process of the high water-level electrode part of this embodiment will now be described.

The electrode 610 and the terminal part 620 are coupled to each other by cocking. In other words, the upper end portion of the electrode 610 is fitted into a coupling hole 622*a* formed at the coupling portion 622 of the terminal part 620, and the portion around the coupling hole 622*a* is pressurized in a circumferential direction. Then, the portion around the coupling hole 622*a* of the terminal part 620 is deformed (D in FIG. 9) so that the electrode 610 can be securely fixed to the terminal part 620.

As apparent from the above description, according to the steam generator in accordance with the present invention, by providing the accommodating part for surrounding the electrode parts of the water level sensor, the malfunction of the water level sensor due to the water film by bubbles and the vibration can be effectively prevented.

Also, by simply modifying the high water-level electrode part, the malfunction of the water level sensor can be more efficiently prevented.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a drum rotatably mounted in the laundry machine for treating laundry placed therein; and a steam generator to generate steam to be supplied to the drum, wherein the steam generator comprises:

an upper housing having an upwardly protruding portion;

a common electrode part;

a low water-level electrode part which senses a low water level; and a high water-level electrode part which senses a high water level, wherein the high water-level electrode part is mounted to the protruding portion, thereby the high-water level electrode part having a lower end which is positioned above a lower end of the low water-level electrode part and an upper end which is positioned above an upper end of the low water-level electrode part.

2. The laundry machine according to claim 1, wherein the low water-level electrode part and the high water-level electrode part are spaced apart from each other by a predetermined distance.

3. The laundry machine according to claim 1, wherein the high water-level electrode part is placed avoiding a place directly above a heat-generated part of a heater.

4. The laundry machine according to claim 1, wherein the high water-level electrode part, the low water-level electrode part, and the common electrode part are all the same in length.

5. The laundry machine according to any one of the claims 1 to 4, further comprising:

an accommodating part for surrounding the high water-level electrode part.

6. A laundry machine, comprising:

a drum rotatably mounted in the laundry machine for treating laundry placed therein; and a steam generator to generate steam to be supplied to the drum, wherein the steam generator comprises:

a common electrode part;

a low water-level electrode part which senses a low water level;

a high water-level electrode part which senses a high water level, the high water-level electrode part having a lower end which is positioned above a lower end of the low water-level electrode part and an upper end which is positioned above the low water-level electrode part; and an accommodating part for surrounding the high water-level electrode part, wherein the accommodating part has a lower end which is positioned above the lower end of the high water-level electrode part.

7. The laundry machine according to claim 6, wherein the accommodating part is formed with at least one cutting portion.

8. A laundry machine comprising:

a drum rotatably mounted in the laundry machine for treating laundry placed therein; and a steam generator to generate steam to be supplied to the drum, wherein the steam generator comprises;

a common electrode part;

a low water-level electrode part which senses a low water level;

a receptacle housing which houses the common electrode part and the low water-level electrode part; and a high water-level electrode part which senses a high water level and is positioned apart from the receptacle housing.

9. The laundry machine according to claim 8, further comprising;

a partition wall which is disposed between the low water-level electrode part and the high water-level electrode part.

10. The laundry machine according to claim 8, further comprising;

an accommodating part for surrounding the high water-level electrode part.

11. The laundry machine according to any one of claims 8 to 10 wherein the high water-level electrode part includes an electrode which comes into contact with water, and a terminal part which is coupled to the electrode.

12. The laundry machine according to claim 11, wherein the electrode and the terminal part are coupled to each other by cocking.

13. The laundry machine according to claim 11, wherein the electrode and the terminal part are made of the same material.

* * * * *